US007975611B2

(12) United States Patent
Björn

(10) Patent No.: US 7,975,611 B2
(45) Date of Patent: Jul. 12, 2011

(54) METAL-SEALING MATERIAL-FEEDTHROUGH

(75) Inventor: Ramdohr Björn, Ergolding (DE)

(73) Assignee: Schott AG, Mainz (DE)

( * ) Notice: Subject to any disclaimer, the term of this patent is extended or adjusted under 35 U.S.C. 154(b) by 321 days.

(21) Appl. No.: 12/062,041

(22) Filed: Apr. 3, 2008

(65) Prior Publication Data

US 2008/0245545 A1 Oct. 9, 2008

(30) Foreign Application Priority Data

Apr. 4, 2007 (DE) ..... 10 2007 016 692

(51) Int. Cl.
*F42B 3/02* (2006.01)

(52) U.S. Cl. ..... 102/202.12; 411/531; D8/399

(58) Field of Classification Search ..... 102/202.7, 102/206, 202.9, 202.12, 202.14; D8/399; 411/531

See application file for complete search history.

(56) References Cited

U.S. PATENT DOCUMENTS

| | | | | |
|---|---|---|---|---|
| 3,274,937 | A | 9/1966 | Kyle | |
| 3,735,664 | A * | 5/1973 | Hermle | 411/531 |
| 4,453,033 | A * | 6/1984 | Duff et al. | 174/527 |
| 5,345,872 | A | 9/1994 | Takahashi et al. | |
| 5,672,841 | A * | 9/1997 | Monk et al. | 102/202.4 |
| D460,684 | S * | 7/2002 | Liao | D8/399 |
| 6,557,474 | B1 * | 5/2003 | Morte et al. | 102/202.1 |
| D528,407 | S * | 9/2006 | Schwab | D8/399 |
| 2009/0044715 | A1 * | 2/2009 | Hartl et al. | 102/202.9 |
| 2009/0158953 | A1 * | 6/2009 | Magne et al. | 102/206 |

FOREIGN PATENT DOCUMENTS

EP 1061325 5/2000

OTHER PUBLICATIONS

PCT/EP2006/068273 Autoliv Development AB.*

* cited by examiner

*Primary Examiner* — Bret Hayes
*Assistant Examiner* — Reginald Tillman, Jr.
(74) *Attorney, Agent, or Firm* — Taylor IP, PC

(57) ABSTRACT

Metal-sealing material-feedthrough, especially for devices which are subjected to high pressures, include at least one metal pin located in a sealing material in a feedthrough opening in a base body, whereby the at least one metal pin is enveloped at least partially by a conductive component element, so that a conductive connection may be created on the one hand between the component element and the metal pin and whereby on the other hand the component element is in contact with the base body, so that a conductive connection can be established between the component element and the base body, the component element possessing a design form to the extent that the component element with respect to its contour essentially follows the contour of the inside wall of the feedthrough opening along a section S.

20 Claims, 6 Drawing Sheets

STATE OF THE ART

A - A

STATE OF THE ART

METAL-SEALING MATERIAL-FEEDTHROUGH

CROSS REFERENCE TO RELATED APPLICATIONS

This application claims priority to German patent application 10 2007 016 692.5, filed on Apr. 4, 2007, which is incorporated herein by reference.

BACKGROUND OF THE INVENTION

1. Field of the Invention

The invention relates to a metal-sealing material-feedthrough, as well as to a component element for a solder bridge.

2. Description of the Related Art

Metal-sealing material-feedthroughs are already known in various forms from the current state of the art. They are understood to be vacuum-tight fusions of sealing materials, especially glass or synthetics to metal seals. In this type of arrangement the metals act as electric conductors. We refer you to representative documentation U.S. Pat. No. 5,345,872 A as well as to U.S. Pat. No. 3,274,937. Feedthroughs of this type are common in electronic and electrical engineering. The material used for sealing, especially glass, serves as an insulator. Typical metal-sealing material-feedthroughs are constructed such that metallic internal conductors are sealed into a pre-formed sintered glass component, whereby the sintered glass component or the glass tube is sealed into an outer casing component—the so-called base body. Regarding the usage of such feedthroughs, reference is made to the webpage of Schott North America Inc. under www.us.schott.com/epackaging. The content of this homepage is incorporated herein by reference. Feedthroughs of this type are used especially in hermetic housings for electronic components, such as for example transistors. The hermetic housings generally consist of a base plate which is formed for example by the base body of the feedthroughs, and a cover which envelops the components.

Since feedthroughs of this type also ensure a hermetic feedthrough at high pressures, feedthroughs of this type are suitable also for use in areas where high pressures occur—for example in components equipped with feedthroughs for high pressures such as pressure sensors or pyrotechnic components which are utilized in the automotive industry such as air bag ignition devices or belt tensioning devices.

Most of the aforementioned feedthroughs include two metal pins. However, more than two metal pins are also feasible. The metal-sealing material-feedthroughs generally include a base body, preferably a metal base body, for example a metal sleeve which is designed as a pivoted component. The metal base body includes at least one feedthrough opening through which at least one metal pin is inserted.

In the case of feedthroughs where there is a voltage to two metal pins it is important that the individual metallic conductors are electrically insulated when being fed through the feedthrough opening. This is achieved in that an electrically non-conductive material such as for example glass is used. Preferably at least one pin is grounded. This is achieved in that the pin is grounded to the base body.

It is known from EP 1 061 325 B1 that grounding of this type may be achieved for example with the assistance of an electrically conductive adhesive.

Alternatively a solder-coated component is suggested in EP 1 061 325 B1 which is arranged on the upper surface of the sealing material and which conductively envelops one of the two metal pins. On the other hand according to EP 1 061 325 B1 the element also contacts the metal base body, so that grounding from the metal pin to the metal component via the component enveloping the metal pin is assured. The solder material essentially ensures a conductive connection between the metal pin and component element on the one hand, and between the component element and the base body on the other hand. A disadvantage of the element in EP 1 061 325 B1 is that—based on the geometry of the component element—the gap between the component element and the inside wall of the base body increases steadily, originating from a point at which the component element and the inside wall are adjoining. If one intends to coat the component element with a solder material in order to improve the bond between component element and inside wall, then the solder material will always flow into the area in which the gap narrows, due to the solder flux. Therefore, this geometry only permits soldering over a section of a maximum of 1/10 of the circumference of the feedthrough opening. Expressed in figures this translates to a soldering along a maximum section of 1.6 mm on the inside wall of a feedthrough opening which has a diameter of 5 mm. These soldering dimensions are however frequently shorter, for example only 1.2 mm. Many times this is too short for a secure contact.

As an alternative to a connection of the metal pin with the assistance of a solder bridge over a component element it has also been demonstrated in the current state of the art to directly solder the metal pin and inside wall. This allowed soldering of sections in the range of 1.5 to 2.2 mm at a feedthrough opening diameter of 5 mm. The metal pin itself however was not occluded, so that only a one-sided connective connection existed between the metal pin and the solder material.

Neither option therefore provides a safe grounding between the metal pin and metal housing of the base body.

What is needed in the art is to improve a metal-sealing material-feedthrough to the extent that the grounding is more reliable, that the feedthrough is more reliably pressure proof and the assembly made simpler.

SUMMARY OF THE INVENTION

The present invention provides a metal-sealing material-feedthrough including a metal pin that is arranged in a sealing material in a feedthrough opening in the base body; a preferably conductive component element or component which envelopes the metal pin at least partially, so that a conductive connection may be created between the metal pin and component element, for example with the assistance of a solder material and that, on the other hand, the component element is in contact with the base body, so that a conductive connection may be established from the component element to the base body, thereby creating the grounding contact. In accordance with the current invention the shape of the component element is such that a conductive contact may be created between the component element and the base body via a section S, for example with the assistance of a solder material, whereby the contour of the component element is essentially consistent with the contour of the inside wall of the feedthrough opening.

The component or component element can be symmetric, for example, so that it possesses three identical outside surfaces. The identical outside surfaces then have all the same curvature and the same length. An example of a component or component element of this type is illustrated in FIGS. 3*a* through 3*c*. The advantage of a symmetrical component of this type is that it may be installed arbitrarily. This eliminates incorrect assembly which is especially important in pyrotechnical applications in the automotive industry. The assembly of such components is therefore approximately 100%, preferably 100%, secure.

With a component where an external contour of the component is not consistent with the inside wall generally only a point contact is created between the component element and the metal component of the base body. In contrast, the inventive design of the component permits an electrical contact over a greater section, between the component and the base body. This has the advantage that even during vibration a secure electric contact occurs between metal pin and component element as well as base body. This achieves an especially secure ground contact. In addition a feedthrough with a component element of this type provides a substantially higher pressure resistance.

The conductive contact between the metal pin and the base body is established by a solder bridge between the metal pin and the base body. The contact is especially secure if the component element possesses an outside contour which is consistent at least in parts with the inside contour of the feedthrough opening. The component element may then be joined with the inside contour of the feedthrough opening of the base body through the solder bridge along a section S.

If the feedthrough opening has a circumference U then the preferred section is $S \geqq 0.12$ U, preferably $\geqq 0.15$, especially preferably $S \geqq 0.2$ U, more especially preferably $S \geqq 0.3$ U. Especially preferred is a range between 0.16 U and 0.20 U, since component elements which possess such a section S may be configured symmetrically, having three identical outside surfaces with regard to curvature and length. This would then provide the aforementioned assembly advantages. If for example, the circumference of the feedthrough opening $U=2\pi r=2\pi \cdot 0.25$ cm=1.57 cm, then S is for example $S \geqq 2.6$ mm. With a feedthrough opening of 2.5 mm, as indicated in the example, S is preferably in the range of between 1.9 mm and 4.5 mm, especially between 2.6 mm and 3.2 mm. The radius of the feedthrough opening is preferably in the range of 0.1 cm to 0.5 cm, in other words is in the range of 1 m to 5 mm.

A conductive section along this relatively large path is possible because the distance between the component element and the inside wall of the feedthrough opening is essentially the same along the entire section S, meaning that the gap width does not increase as is the case in the current state of the art, but remains largely constant.

If the feedthrough opening is designed in the form of a hollow cylinder—for example a sleeve—with a radius in reference to a center line it is preferred if the component element includes an outside surface at least in sections, which has the same radius as that of the hollow cylinder. This ensures the same gap width along the entire section.

The sealing material into which the at least one metal pin is sealed can have two faces. The sealing material is then applied onto at least one of the two faces. It is especially preferred if such a component element is already placed during the assembly of the parts during the sealing process in which the metal pin is sealed into the sealing material. The method to produce the feedthrough then includes for example of the following steps:

- the metal pins are initially pushed into the sealing material and the sealing material placed in the base body;
- the component element is placed on the sealing material in an additional step;
- subsequently the solder material is applied onto the component element;
- in a last step the component element is subjected to a thermal treatment in a temperature range of 850° C. to 1020° C., so that the sealing material can fuse together with the base body.

In the last process step the sealing material also flows and forms the solder bridge over the component element from the metal pin to the base body. Hard solder material is the preferred solder material.

In addition to an arrangement of the method whereby a solder and a solder carrier is used it would also be feasible to utilize sandwich materials consisting of solder/solder carrier.

All conductive metals may be considered as suitable materials for the component element, especially however copper, steel and nickel silver.

Sealing of the component together with the metal pin or pins into the sealing material offers special advantages with regard to a simple fabrication. Even refinishing is no longer necessary in this scenario.

As described previously it is advantageous if for example a glass material is used as the sealing material. Other materials such as high efficiency polymers, glass ceramics, and glass powders in polymer matrix, metallized ceramics or ceramics without metallization are also feasible.

There are no limitations regarding the geometry of the outside contour of the base body. There are also no limitations regarding the geometry of the feedthrough opening. However, a feedthrough opening arrangement which is designed symmetrical to a center axis, in other words which is circular is preferred. The inside surface of the feedthrough opening may then be described by a radius with reference to a center axis.

The inventive feedthrough is primarily used as a feedthrough in components or devices which are subjected to high pressures. Such components or devices are also briefly described as components suitable for high pressures. Components for high pressures are for example pyrotechnic devices, especially for use in the automotive industry, for example airbags, belt tensioning devices, pyrotechnic headrests, pyrotechnic roll bars, devices for pyrotechnic engine hood lift, pyrotechnic electric circuitry disconnection, for example pyrotechnic disconnection of the battery. This short listing represents only a few examples and is in no way limited to same.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1A:
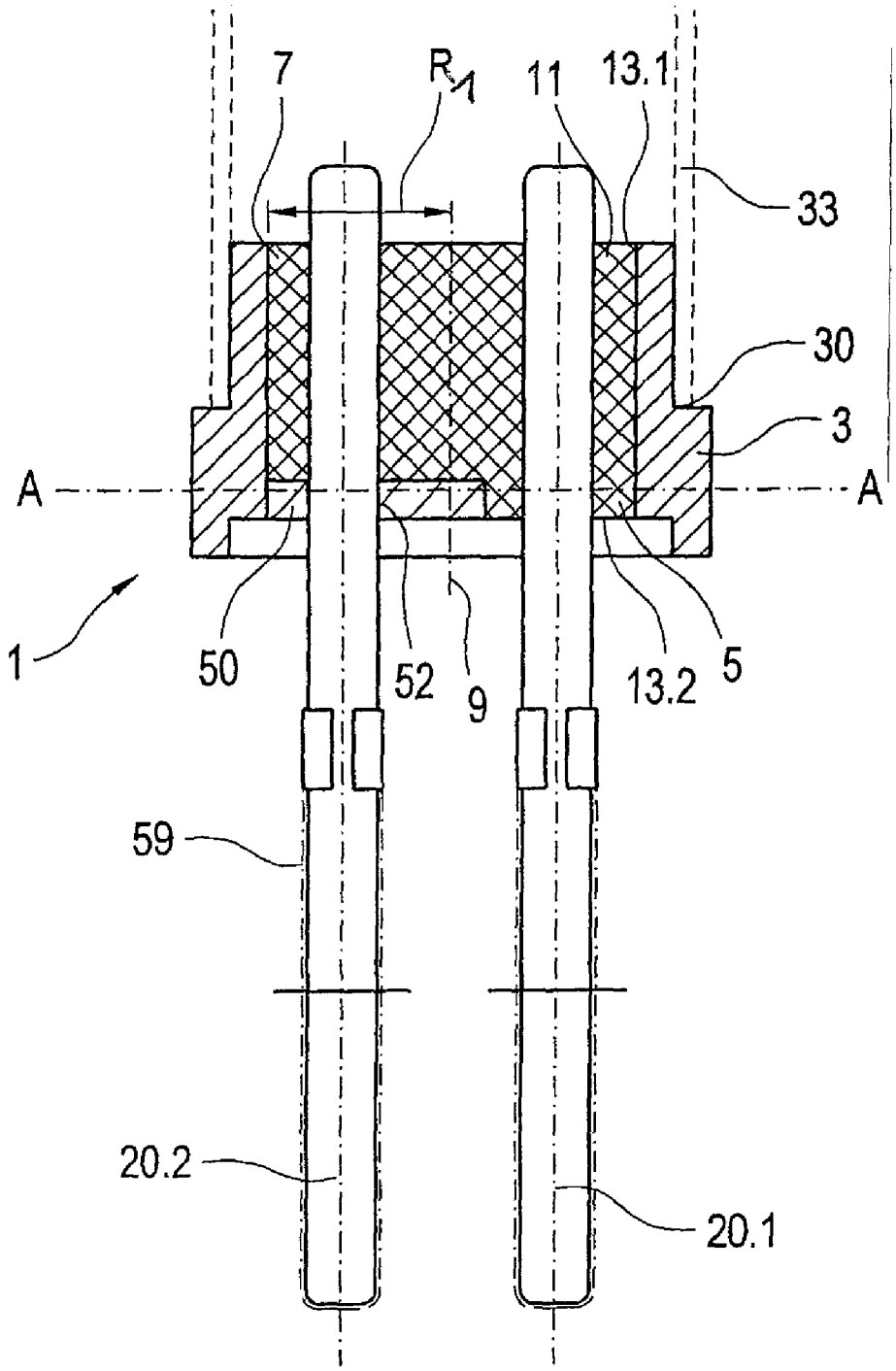
FIGS. 1*a-b* show an embodiment of the inventive metal-sealing material-feedthrough with an inventive component element.

Referring now to the drawings, and more particularly to FIG. 1*a*, there is shown a sectional view of the inventive metal-sealing material-feedthrough 1. The dash-dot line also shows the sleeve or cap 33 which is placed on the feedthrough and which for example houses an electrical component, for example a transistor. The inventive metal-sealing material-feedthrough also includes a base body 3 which is preferably produced from a conductive metal.

The base body 3 is designed preferably as a pivoted component, for example in the embodiment of a metal sleeve and includes a feedthrough opening 5. The feedthrough opening 5 includes an inside wall 7 with an inside contour. If the feedthrough opening is circular, that is if it has an axis of symmetry 9 then the inside contour is defined by a radius $R_1$. The sealing material 11 which possesses two faces—an upper face 13.1 and a lower face 13.2 is placed into the feedthrough opening 5. The two metal pins 20.1 and 20.2 protrude beyond the upper and lower faces 13.1, 13.2 of the sealing material 11. Advantageously the sealing material 11 is a glass material into which the metal pins 20.1, 20.2 are sealed. The sealing material 11 with the metal pins 20.1, 20.2 which form a glass slug is fused into the feedthrough opening 5.

In addition the circulatory soldered edge 30 of the base body 3 is depicted. The cap 33 which houses the electric component, for example a transistor, is positioned on the soldered edge 30 and is welded to it. The component which is advantageously fused together with the glass slug which accommodates the metal pins 20.1, 20.2 is identified with the number 50. The component element 50 includes a bore 52 which surrounds the outside circumference of the one metal pin 20.2. A connective connection between metal pin 20.2 and component element 50 may be created merely through contact of the component element 50 with the metal pin 20.2. However, a more reliable joining of the component element 50 with the metal pin 20.2 is achieved through utilization of a solder material. On the other hand, the component element 50 adjoins the inside wall 7 of the base body 3 and may form a conductive connection between component element 50 and base body 3. Here too, a solder material could advantageously be used. If the base body 3 is grounded, then grounding is achieved for the metal pin 20.2. As previously described the connective connection is preferably arranged as a solder connection which connects the metal pin 20.2 with the component element 50 and the component element 50 with the inside wall 7 of the feedthrough opening 5. The special design of the component element 50 according to the invention is illustrated on the top view of the metal-sealing material-feedthrough 1, section A-A in FIG. 1*a* and FIG. 1*b*. As can be seen in the sectional view, the component element 50 is constructed such that it's outside contour 54 is in even close surface contact along a section S, and therefore with the inside contour 56 of the feedthrough opening 5. This means that a gap between the component element 50 and the inside wall 7 of the feedthrough opening 5 is bridged with the assistance of a solder bridge which is essentially the same width along the entire section S. This enables the formation of a solder bridge along the entire section S, representing a conductive connection between the component element 50 and the inside wall 7. If the feedthrough opening 5 has a radius $R_1$, then a circumference of $U=2\pi R_1$. The section S along which the component element 50 adjoins with the feedthrough opening 5 is preferably $S \geqq 0.12$ U, especially $S \geqq 0.15$ U, advantageously $S \geqq 0.2$, especially advantageously $S \geqq 0.3$ U.

This ensures a secure grounding of the metal pin 20.2 with the base body 3. A preferred embodiment of the component element 50 in the form of a triangle whose sides exhibit the radius of the inside wall 7 of the feedthrough opening 5 is depicted and described in detail in FIGS. 3*a* through 3*c*.

Figure 2A:
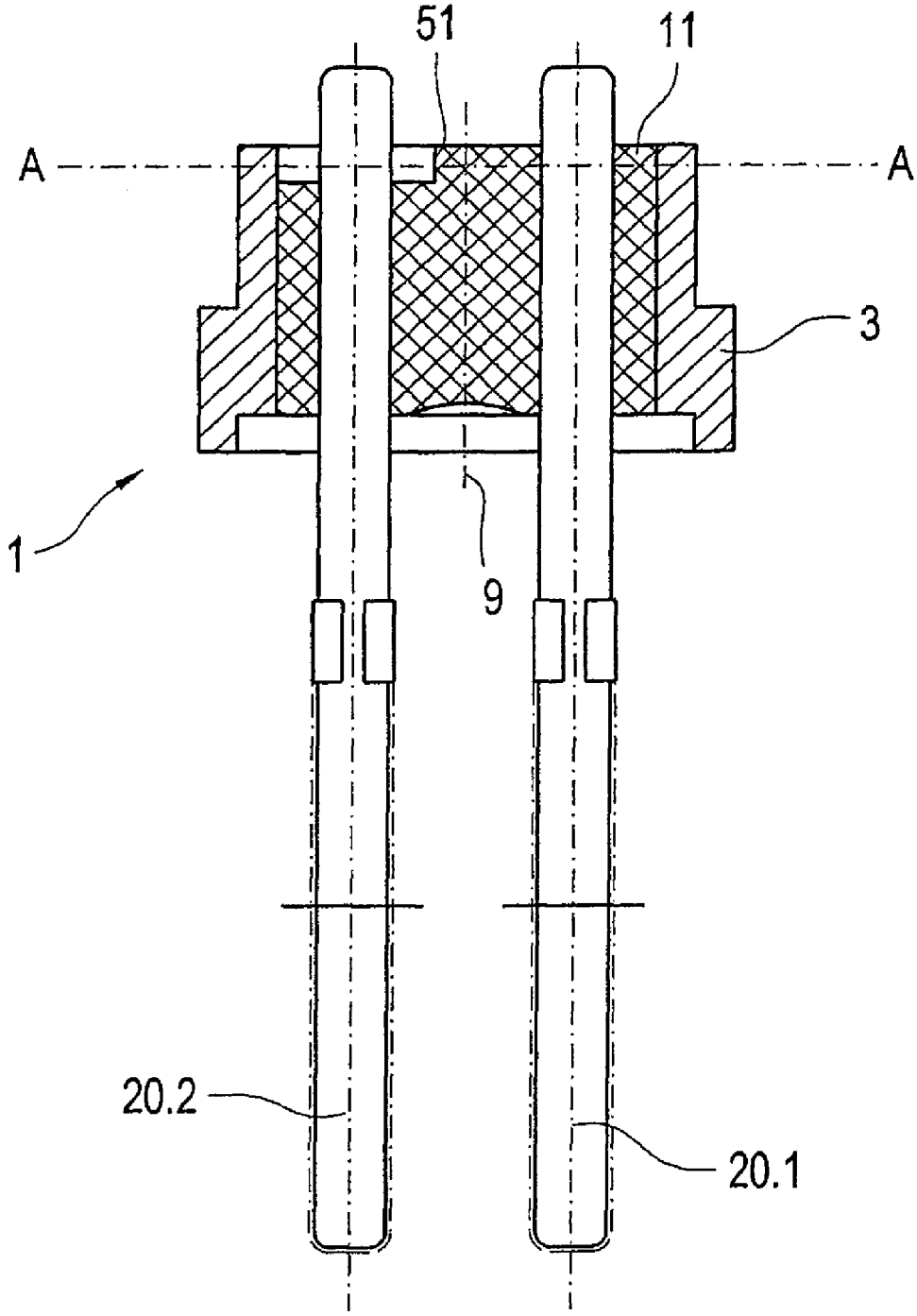
FIGS. 2*a-b* illustrate the inventive metal-sealing material-feedthrough according to the current state of the art.
Figure 2B:
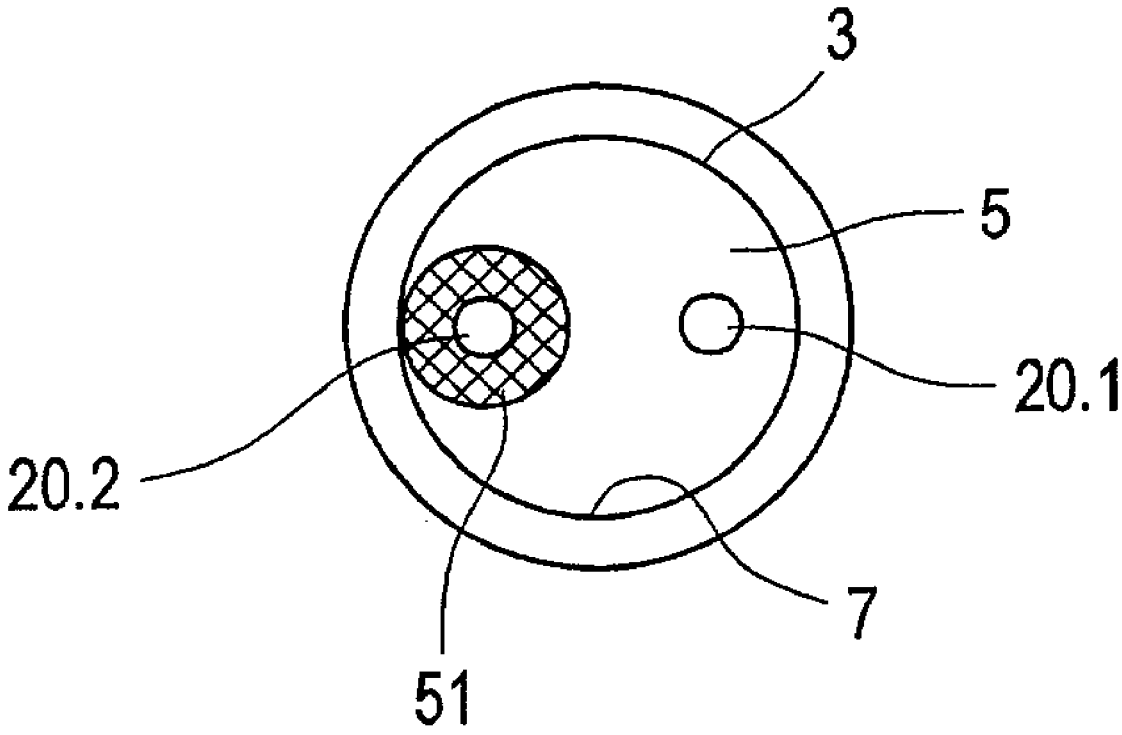

FIGS. 2*a* through 2*b* show one embodiment of a solder bridge including a component element 51 according for example to EP 1 061 325. FIG. 2*a* again shows a sectional view through the metal-sealing material-feedthrough 1 and FIG. 2*b* illustrates a top view.

Identical components are identified with the same identification numbers.

As can be seen in FIG. 2*b*, especially in the top view, the component element 51 is designed as a circular component which has a distinctly smaller diameter than the diameter for example of the circular feedthrough opening 5. Since the diameter $R_2$ of the component element 51 is smaller than $R_1$ of the feedthrough opening 5, there is no even surface contact between the component element 51 and the inside wall 7 of the feedthrough opening 5—only a point-type contact. The gap between the component element 51 and the inside wall 7 increases with increasing distance on the inside wall 7 from the point-type contact point. Therefore, with a feedthrough opening 5 diameter of for example 5 mm solder bridges can only be achieved over a section of 1.2 mm to maximum 1.7 mm. From the point of view of operational safety this is a disadvantage.

Figure 2C:
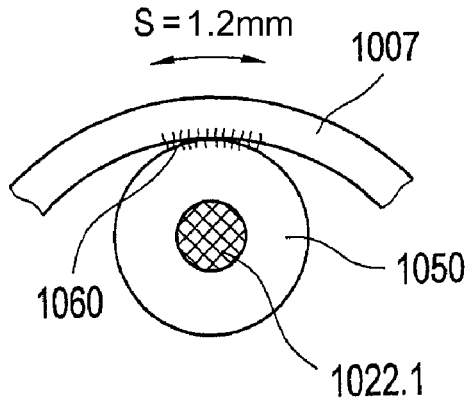
FIGS. 2*c-e* illustrate various solder bridges.
Figure 2D:
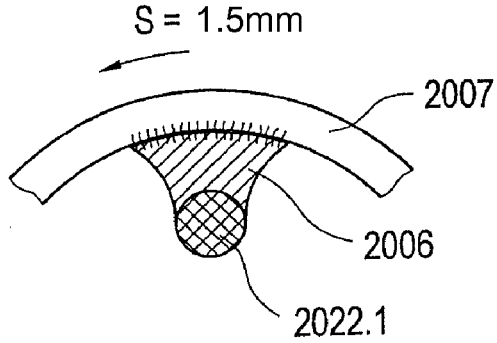
Figure 2E:
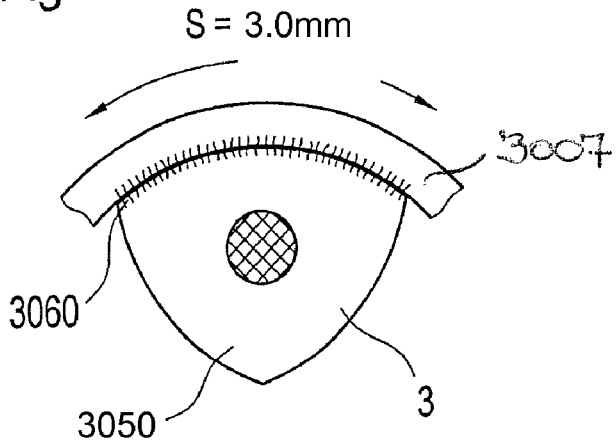

This is again demonstrated in FIGS. 2*c* through 2*e*.

FIG. 2*c* shows the possible solder bridge between component element 1050, inside wall 1007 and metal pin 1022.1, across the component element 1050. As can be clearly seen, the gap 1060 between component element 1050 and inside wall 1007 increases the further one moves along the inside wall 1007. With a feedthrough opening diameter of 5 mm, solder lengths of a maximum of only 1.2 to 1.7 mm are achievable in this design variation.

FIG. 2*d* illustrates an alternate embodiment of a conductive connection between metal pin 2022.1 and inside wall 2007. In this example the solder material 2006 is soldered onto the inside wall 2007 directly and not by way of a solder bridge. With a feedthrough opening diameter of 5 mm, sections of 1.5 mm to 2.2 mm can be achieved on the inside wall, however on the metal pin 2022.1 itself only distances of 1 mm can be realized. In addition, the metal pin 2022.1 is connected only on one side.

FIG. 2*e* on the other hand depicts the inventive solution. The component 3050 fits against the inside wall 3007 along the section S. The gap 3060 which is bridged by the solder bridge is approximately the same along the entire distance. Therefore, the solder bridge can be realized along the entire section S along which the component 3050 is in contact with the inside wall 3007. At feedthrough opening diameters of 5 mm, this enables contact lengths of more than 2.2 mm, especially in the range of 2.5 mm to 3.5 mm.

Even through concrete figures are cited, this should not be interpreted as a limitation, but only as a preferred design form. The invention exists essentially in that the contours of the component element 50 which is being utilized as solder bridge are adapted on the one hand to the metal pin 20.2 which is preferably surrounded by the component element 50, and to the inside wall 7 of the base body 3 to which the ground contact is established.

Figure 1B:
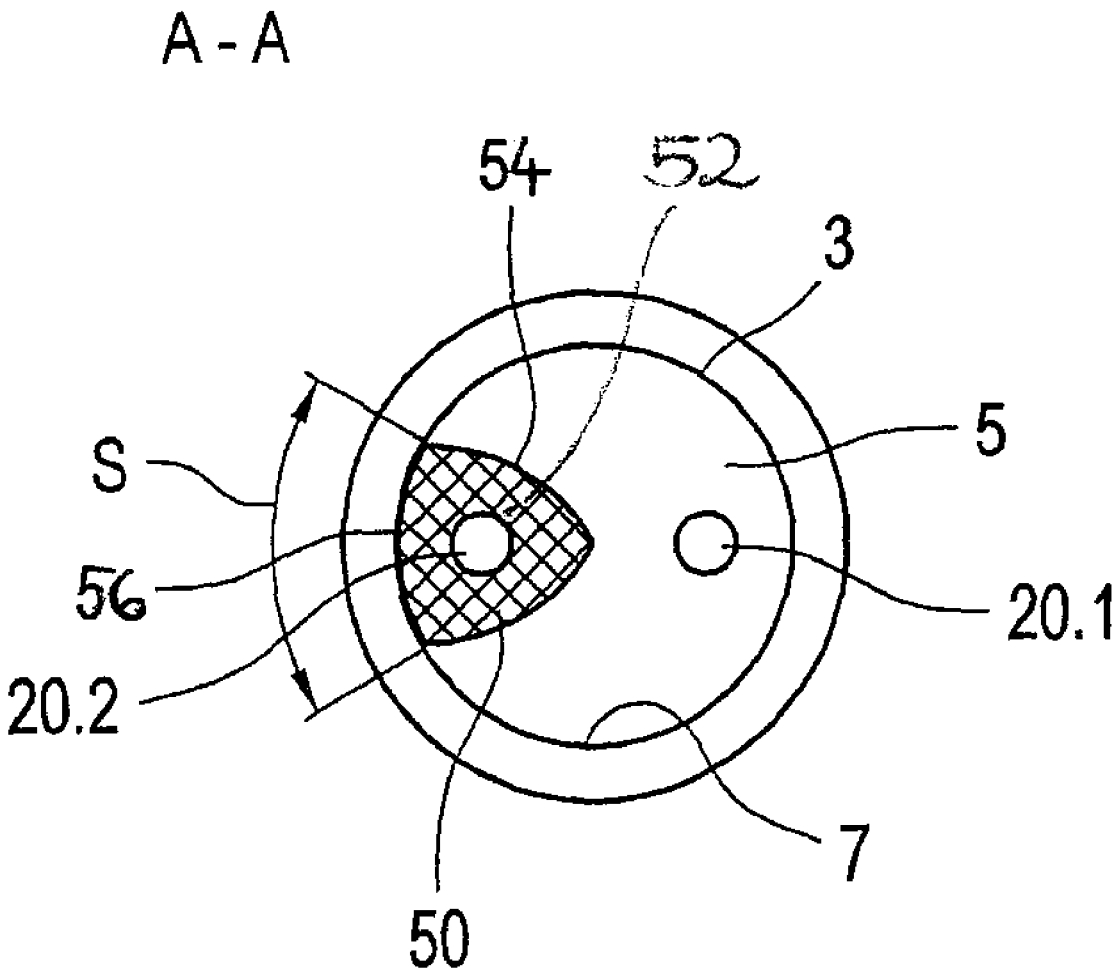
Figure 3A:
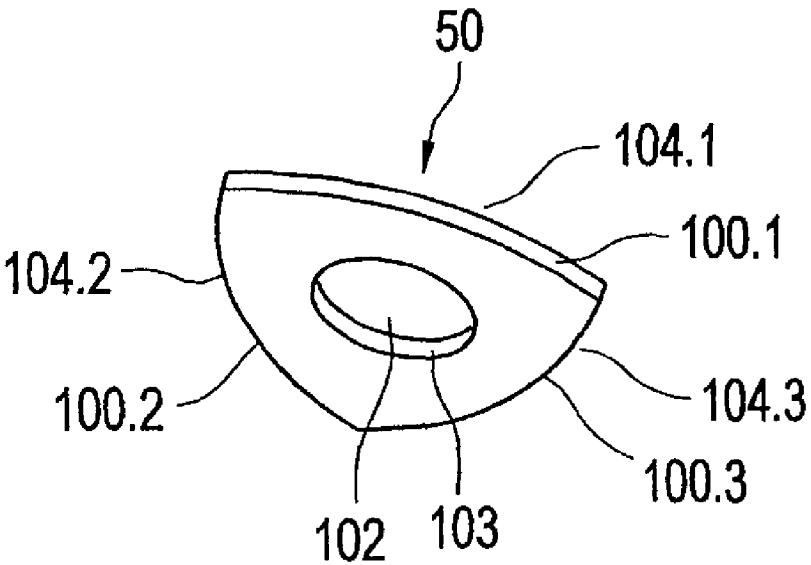
FIGS. 3*a-c* depict views of the component itself.
Figure 3B:
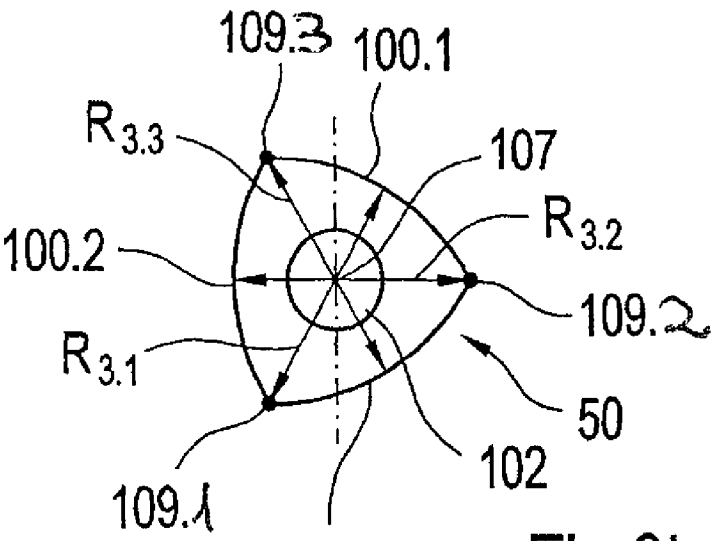
Figure 3C:
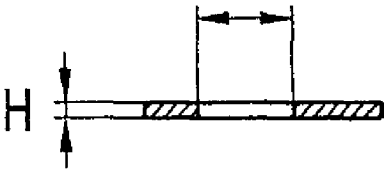

A detailed view of a component element 50 as shown in FIGS. 1*a* through 1*b*, according to the invention is depicted in FIGS. 3*a* through 3*c*.

A three-dimensional view of the component element 50 is shown in FIG. 3*a*. The preferred triangular form of the component element 50 is clearly recognizable. The component element 50 has a total of three surfaces 100.1, 100.2, 100.3 on its outside, as well as a bore 102 which accommodates the metal pin. The radius of the bore 102 is consistent with the radius of the metal pin 20.2 which will be inserted through it.

The inside surface 103 of the bore is in contact with the outside surface of the metal pin 20.2, thereby providing the conductive connection. A solder material is preferably used in order to render this contact even more reliable. The outside contour 104.1, 104.2, 104.3 of the three respective sides of the component element 50 has a curvature which is consistent with the curvature of the inside wall 7 of the feedthrough opening 5.

This can be seen clearly on the top view according to FIG. 3*b*. The component element 50 has a first axis 107 which defines the curvature of the inside surface of the feedthrough bore 102. Regarding the curvature of the three outside surfaces 100.1, 100.2, 100.3 the respective axis 109.1, 109.2, 109.3 on which the radius of the respective outside surface 100.1, 100.2, 100.3 is defined for the component element are also depicted.

The radii are identified in this example with $R_{3.1}$, $R_{3.2}$, $R_{3.3}$. Preferably the radii $R_{3.1}$, $R_{3.2}$, $R_{3.3}$ correspond essentially with the radius $R_1$ of the feedthrough opening 5 according to FIG. 1*a*. As can be seen from FIGS. 3*a* through 3*b*, the component element 50 is symmetrically constructed, in order to ensure a 100% secure assembly and to avoid installation errors. Symmetrically constructed means that the curve lengths for the respective outside surfaces 100.1, 100.2, 100.3 are essentially identical and also the radii $R_{3.1}$, $R_{3.2}$, $R_{3.3}$ which also characterizes the outside surfaces 100.1, 100.2, 100.3.

FIG. 3*c* illustrates a sectional view of the component element 50 according to FIGS. 3*a* and 3*b*. The height H of the component is preferably 0.025 to 1.00 mm, the diameter D of the bore 102 is preferably 0.25 to 5 mm, preferably 0.4 mm to 2.5 mm, especially preferably 0.75 to 1.5 mm, above all 0.9 to 1.25 mm. The diameter of the metal pin 20.2 is 0.1 mm to 3 mm. Metal pins 20.2 having a diameter of 0.3 mm or 2.5 mm or also 3 mm are feasible. The size of the bore then depends on the size of the metal pins 20.2.

The conductive connection between inside conductive component element and base body 3 as outside conductor is established, as described, with the assistance of solder material and the solder carrier which may for example consist of copper.

The inventive component element 50 is preferably a punched component. Also the base body 3 may be designed as a punched component, either partially or in its entirety.

For example, only the feedthrough opening 5 could be punched in the base body 3.

The inventive feedthrough is utilized especially as feedthrough for components or devices which are subjected to high pressures. Components for high pressures are for example pyrotechnic devices, especially for use in the automotive industry, for example airbags, belt tensioning devices, pyrotechnic headrests, pyrotechnic roll bars, devices for pyrotechnic engine hood lift, pyrotechnic electric circuitry disconnection, for example pyrotechnic disconnection of the battery.

The inventive concept provides especially for a safer grounding than for example the grounding shown in EP 1 061 325 A.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A metal-sealing material-feedthrough for a device which is subjected to high pressures, said metal-sealing material-feedthrough comprising:

a sealing material;

a base body including a feedthrough opening having an inside wall with a contour;

a component element which is conductive, said component element including an outer perimeter and a contour which essentially follows said contour of said inside wall of said feedthrough opening along a section of said feedthrough opening, said outer perimeter being noncircular; and a first metal pin located in said sealing material in said feedthrough opening in said base body, said first metal pin being enveloped at least partially by said component element such that a first conductive connection can be established between said component element and said first metal pin, said component element being in contact with said base body such that a second conductive connection can be established between said component element and said base body, said component element not surrounding a second metal pin.

2. The metal-sealing material-feedthrough in accordance with claim 1, further comprising a plurality of metal pins including at least said first metal pin and said second metal pin.

3. The metal-sealing material-feedthrough in accordance with claim 1, wherein said component element includes an outside contour which is consistent, at least in a plurality of sections of said outside contour, essentially with said contour of said feedthrough opening, said contour of said feedthrough opening being an inside contour.

4. The metal-sealing material-feedthrough in accordance with claim 3, wherein said inside wall has an inside surface with a first curvature, said component element having an outside surface with at least one second curvature, said first and second curvatures being essentially the same.

5. The metal-sealing material-feedthrough in accordance with claim 4, wherein said feedthrough opening includes a hollow cylinder with a first radius, said outside surface of said component element having at least in a plurality of sections of said outside surface a second radius, said first radius largely corresponding with said second radius.

6. The metal-sealing material-feedthrough in accordance with claim 1, further comprising a plurality of metal pins including only said first metal pin and said second metal pin, said first and second metal pins being located in said sealing material in said feedthrough opening, said component element enveloping said first metal pin.

7. The metal-sealing material-feedthrough in accordance with claim 1, wherein said sealing material in said feedthrough opening has a first face and a second face, said first metal pin protruding on at least one of said first face and said second face from said sealing material, said component element being located at said second face on which said first metal pin protrudes beyond said sealing material.

8. The metal-sealing material-feedthrough in accordance with claim 7, wherein said component element is flush with said second face.

9. The metal-sealing material-feedthrough in accordance with claim 1, wherein said first metal pin is joined firmly with said sealing material, thereby resulting in a sealing material slug.

10. The metal-sealing material-feedthrough in accordance with claim 9, wherein said first and second metal pins are fused with said sealing material.

11. The metal-sealing material-feedthrough in accordance with claim 1, wherein said sealing material includes one of a glass slug formed by molten glass and a high efficiency polymer.

12. The metal-sealing material-feedthrough in accordance with claim 1, wherein at least said feedthrough opening is stamped from said base body.

13. The metal-sealing material-feedthrough in accordance with claim 1, wherein said base body is a punched component.

14. The metal-sealing material-feedthrough in accordance with claim 1, wherein said component element is symmetrical.

15. The metal-sealing material-feedthrough in accordance with claim 14, wherein said component element includes at least three outside surfaces, each of said at least three outside surfaces including a curve length and a radius of curvature, each said curve length being essentially the same, each said radius of curvature being essentially the same.

16. The metal-sealing material-feedthrough in accordance with claim 15, wherein said at least three outside surfaces includes only three said outside surfaces.

17. The metal-sealing material-feedthrough in accordance with claim 1, wherein said component element is a punched component.

18. A component element for a solder bridge of a metal-sealing material-feedthrough, said component element comprising:

an outer perimeter which is noncircular and includes at least three outside surfaces, each including a curve length and a radius of curvature, each said curve length being essentially the same, each said radius of curvature being essentially the same, the component element being symmetrical, said component element being configured for surrounding a first conductive pin but not a second conductive pin, each of said outside surfaces being configured for selectively following essentially a contour of an inside wall of a feedthrough opening of a base body of the metal-sealing material-feedthrough along a section of said feedthrough opening.

19. The component element in accordance with claim 18, wherein said at least three outside surfaces includes only three said outside surfaces.

20. The component element in accordance with claim 18, wherein the component element is a punched component.

* * * * *